US008869783B2

(12) United States Patent
Faherty

(10) Patent No.: US 8,869,783 B2
(45) Date of Patent: Oct. 28, 2014

(54) MOBILE HUNTING BLIND

(71) Applicant: Jay Faherty, Gladstone, MO (US)

(72) Inventor: Jay Faherty, Gladstone, MO (US)

( * ) Notice: Subject to any disclaimer, the term of this patent is extended or adjusted under 35 U.S.C. 154(b) by 93 days.

(21) Appl. No.: 13/734,792

(22) Filed: Jan. 4, 2013

(65) Prior Publication Data

US 2013/0174826 A1 Jul. 11, 2013

(51) Int. Cl.

| | |
|---|---|
| ***F41B 5/14*** | (2006.01) |
| ***E04H 15/00*** | (2006.01) |
| ***F41H 3/02*** | (2006.01) |

(52) U.S. Cl.

CPC ..... *F41B 5/1496* (2013.01); *E04H 15/001* (2013.01); *F41H 3/02* (2013.01)

USPC ..... 124/86

(58) Field of Classification Search

USPC ..... 124/86, 88

See application file for complete search history.

(56) References Cited

U.S. PATENT DOCUMENTS

| | | | | |
|---|---|---|---|---|
| 4,974,575 | A * | 12/1990 | Mitchell | 124/88 |
| 5,944,041 | A * | 8/1999 | Kitchens | 135/98 |
| 6,561,523 | B1 | 5/2003 | Wienhold | |
| 7,216,644 | B2 | 5/2007 | Haugen | |
| 7,275,532 | B2 | 10/2007 | Niemackl et al. | |
| 7,594,514 | B2 | 9/2009 | Fereghetti et al. | |
| 7,828,003 | B2 * | 11/2010 | Montecucco | 135/98 |
| 8,720,428 | B2 * | 5/2014 | Jantzen | 124/86 |

* cited by examiner

*Primary Examiner* — John Ricci

(74) *Attorney, Agent, or Firm* — Erickson Kernell Derusseau & Kleypas, LLC

(57) ABSTRACT

A camouflage blind for hunting, photography, and the like is described. The blind includes a central hub with a plurality of legs pivotally coupled thereto and coupled to a fabric cover at distal ends thereof. The legs are pivotable between a generally parallel closed orientation to a deployed orientation extending radially outwardly from the hub. Tension in the cover provides an over-center condition that retains the legs in the deployed orientation. The hub includes a mounting member with a faceted rod for coupling to a coupling member associated with a bow, stand, or other support. A support leg can be flexibly coupled to the mounting member to support the blind on a surface. A supplemental cover having an elastic band disposed in the perimeter thereof can be disposed on the blind to overlay the cover and thereby easily change or enhance camouflage patterns in the field.

19 Claims, 14 Drawing Sheets

MOBILE HUNTING BLIND

CROSS-REFERENCE TO RELATED APPLICATIONS

This application claims priority to U.S. Provisional Patent Application No. 61/583,347, filed Jan. 5, 2012, the disclosure of which is hereby incorporated herein in its entirety by reference.

BACKGROUND

Hunters and photographers use blinds to camouflage themselves from wildlife. There are a number of camouflage systems that work well for specific applications. U.S. Pat. No. 7,275,532 to Niemackl et al. shows a bow blind with a rigid, non-folding, X-shaped frame. U.S. Pat. No. 7,275,532 to Haugen describes another bow blind that couples to a bow and is foldable generally in half. Neither of these blinds provides a device that is highly compact for storage and transport as well as easily coupleable to a variety of mounts. U.S. Pat. No. 7,594,514 to Fereghetti et al. shows another X-frame blind with a hub and interchangeable camouflage fabric sheets. The Fereghetti device employs a ball-and-socket mounting system to mount on an observation platform or associated structure. As such, a hunter must maneuver around the blind to see and/or shoot his target.

SUMMARY

Embodiments of the invention are defined by the claims below, not this summary. A high-level overview of various aspects of the invention are provided here for that reason, to provide an overview of the disclosure, and to introduce a selection of concepts that are further described in the Detailed-Description section below. This summary is not intended to identify key features or essential features of the claimed subject matter, nor is it intended to be used as an aid in isolation to determine the scope of the claimed subject matter. In brief, this disclosure describes, among other things, a collapsible hunting blind.

The hunting blind includes a frame comprised of a central hub with a plurality of legs pivotally coupled thereto. A covering, such as a section of cloth material having a camouflage pattern printed thereon, is disposed on the frame and couples to distal ends of the legs. A mounting member extends from a side of the central hub opposite the covering to couple the hunting blind to a bow, a stand, or another support device. A quick-connect-style coupling can be employed to increase ease and speed of coupling the mounting member of the hunting blind to the support device.

To deploy the hunting blind the legs are spread from a generally parallel folded orientation to a deployed orientation extending radially outward from the central hub. The legs and covering are dimensioned to create an over-center condition. Spreading and/or flexing of the legs beyond the over-center point at least partially stretches the covering. Tension in the covering thereby retains the legs in the deployed orientation.

In an embodiment, one or more supplemental coverings are provided. The supplemental coverings are dimensioned to overlay the covering and to at least partially wrap around the perimeter thereof. A tension member, such as an elastic band, is provided on the perimeter of the supplemental covering to retain engagement of the supplemental covering with the hunting blind while in the deployed orientation. The supplemental coverings can provide alternative and additional camouflage patterns as well as sound and weatherproofing qualities among others.

DESCRIPTION OF THE DRAWINGS

Illustrative embodiments of the invention are described in detail below with reference to the attached drawing figures, and wherein.

DETAILED DESCRIPTION

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described.

Figure 1:
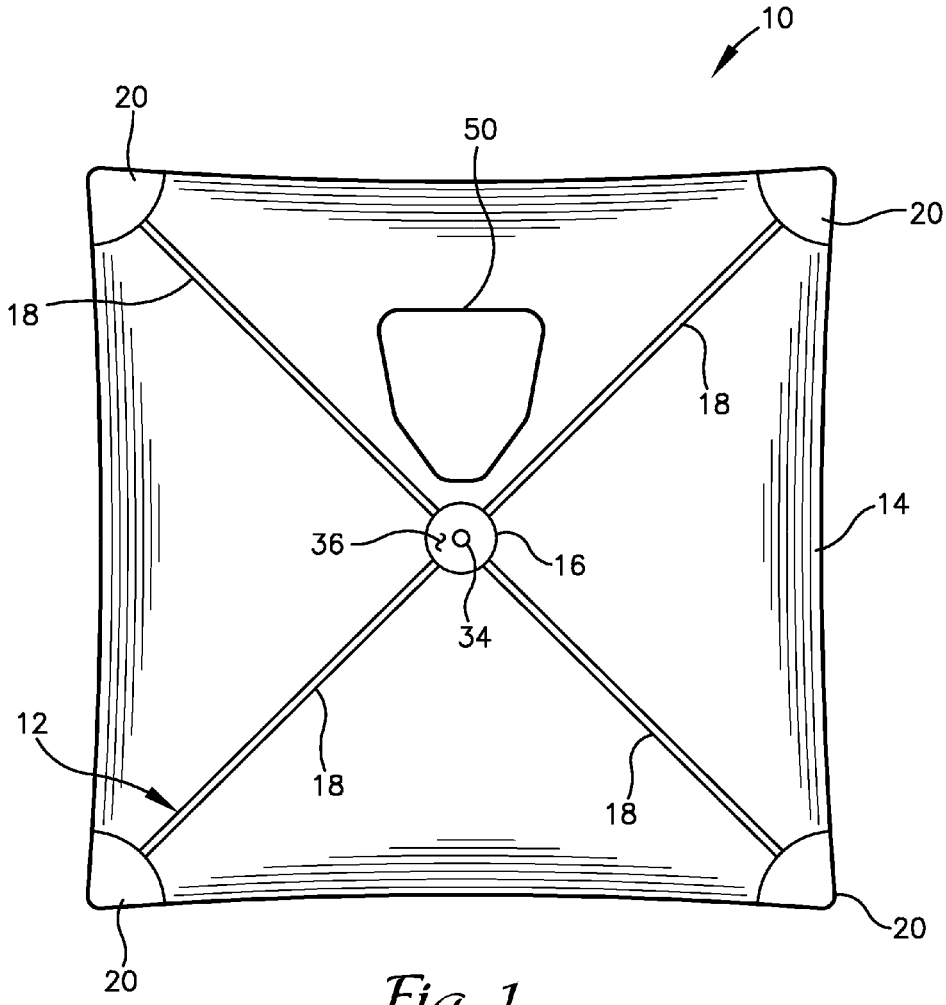
FIG. 1 is a rear elevational view of a hunting blind depicted in accordance with an embodiment of the invention.

With reference to the drawings, FIG. 1 illustrates a hunting blind 10 in accordance with an embodiment of the invention. The blind 10 comprises a frame 12 and cover 14. The frame 12 includes a central hub 16 with a plurality of legs 18 pivotally coupled thereto and extending radially outward therefrom in a generally X-shaped arrangement. Although four legs 18 are depicted herein to form a generally square blind 10, any number of legs 18 and overall shape of the blind 10 can be employed without departing from the scope of embodiments of the invention. A proximate end of each leg 18 inserts into the hub 16 and an opposite distal end is inserted into a pocket 20 formed near the perimeter of the cover 14.

Figure 2:
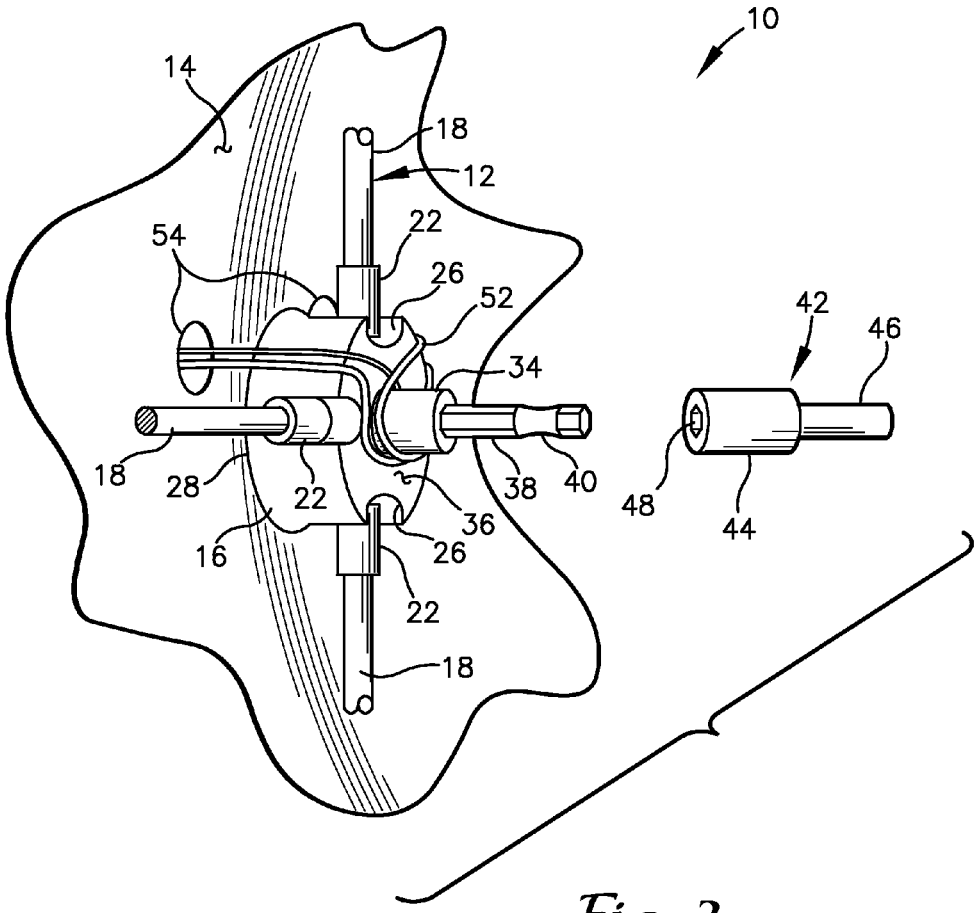
FIG. 2 is an enlarged and fragmentary perspective view of a central hub of the hunting blind of FIG. 1.

As depicted in FIG. 2, the proximate end of each leg 18 is inserted into a respective pivotable receiver 22 in the hub 16. The pivotable receivers 22 include a generally cylindrical body with a blind bore into which the legs 18 are inserted and frictionally retained therein. Fasteners, protuberances, or other physical means as well as adhesives, glues, or other bonding means can be employed to retain the legs 18 in the receivers 22. Preferably, the bore in the receivers 22 is sized to provide a snug friction fit with an exterior wall of the legs 18. Or a layer of frictional material, such as electrical tape, can be applied around the proximate end of the leg 18 to provide desired dimensions and frictional properties. Such is desired to enable replacement of one or more of the legs 18 in the field. In one embodiment, the legs 18 have a length and diameter that is equal to or less than that of a standard shaft of an arrow commonly used in hunting. As such, a broken leg 18 can be replaced in the field, e.g. during a hunt, with an available arrow shaft. When the leg 18 is shorter than the arrow shaft, the arrow shaft can be easily cut to the desired length while in the field.

Figure 3A:
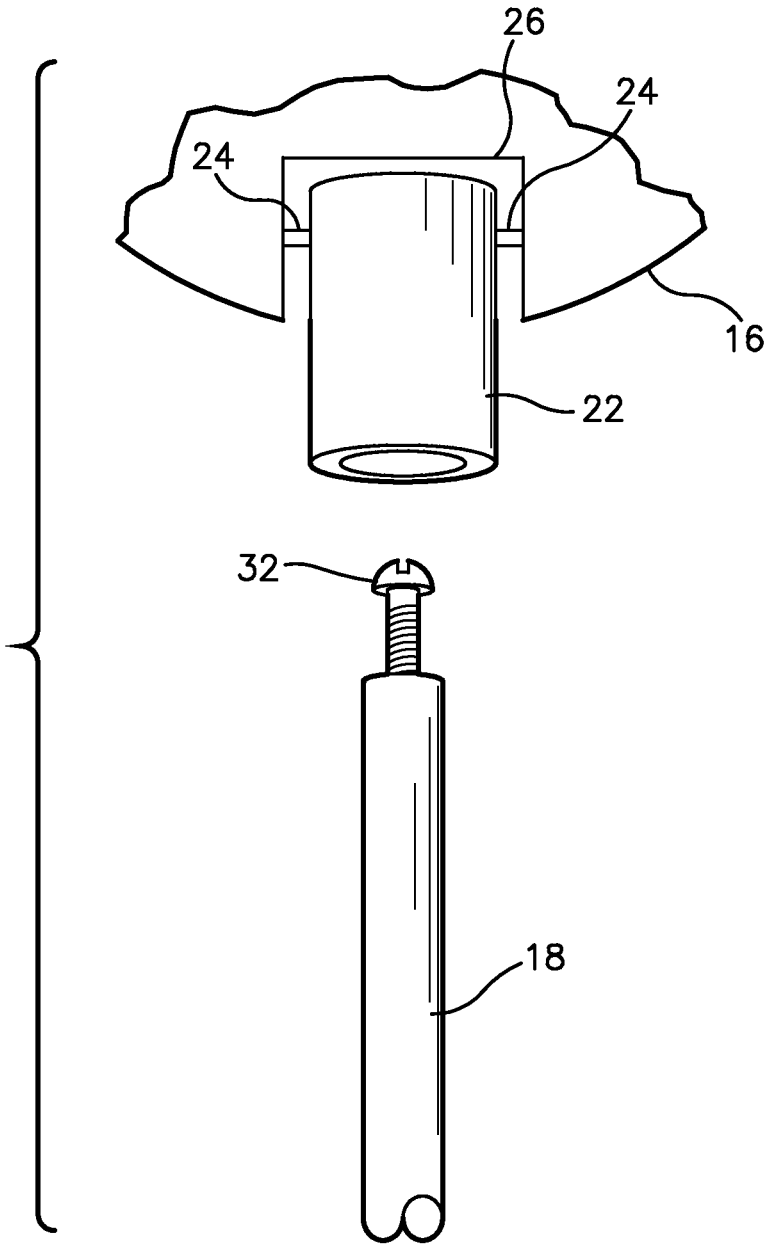
FIG. 3A is a fragmentary perspective view of a leg and a receiver of the central hub of the hunting blind of FIG. 1.
Figure 4:
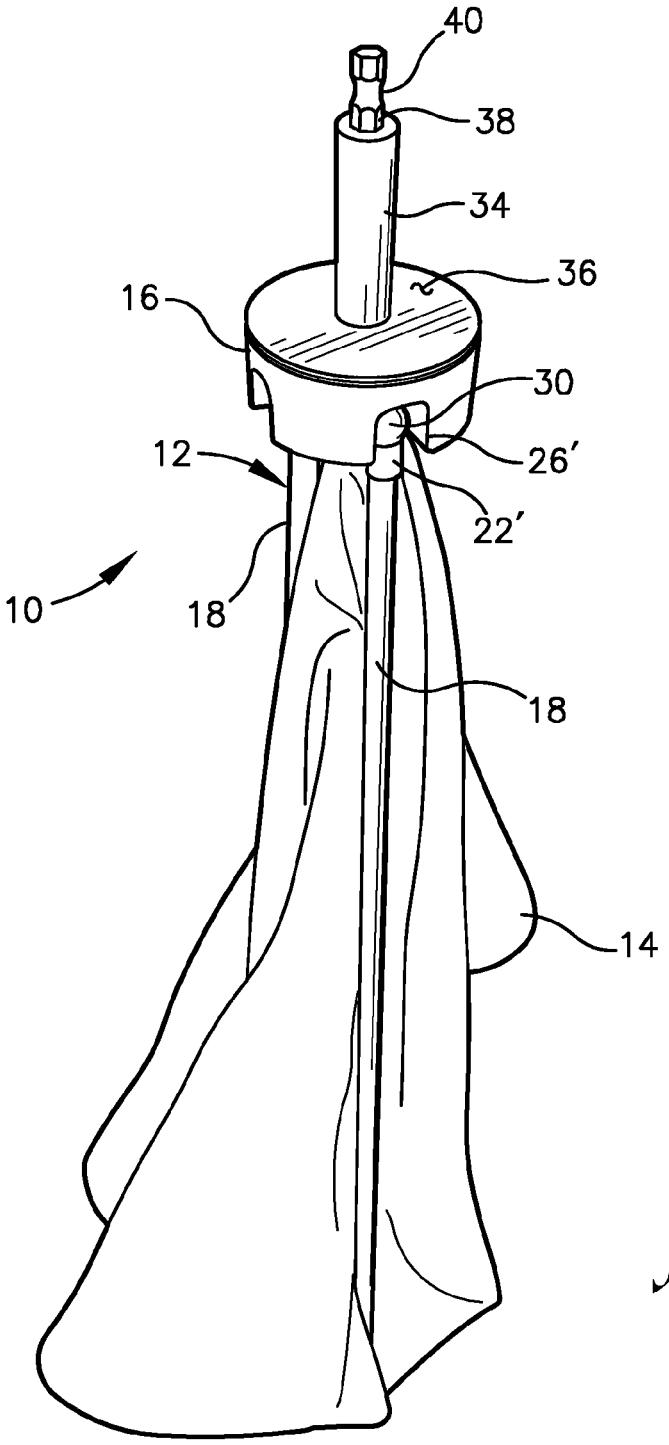
FIG. 4 is a perspective view of the hunting blind of FIG. 3B depicted in a folded or closed orientation in accordance with an embodiment of the invention.
Figure 5:
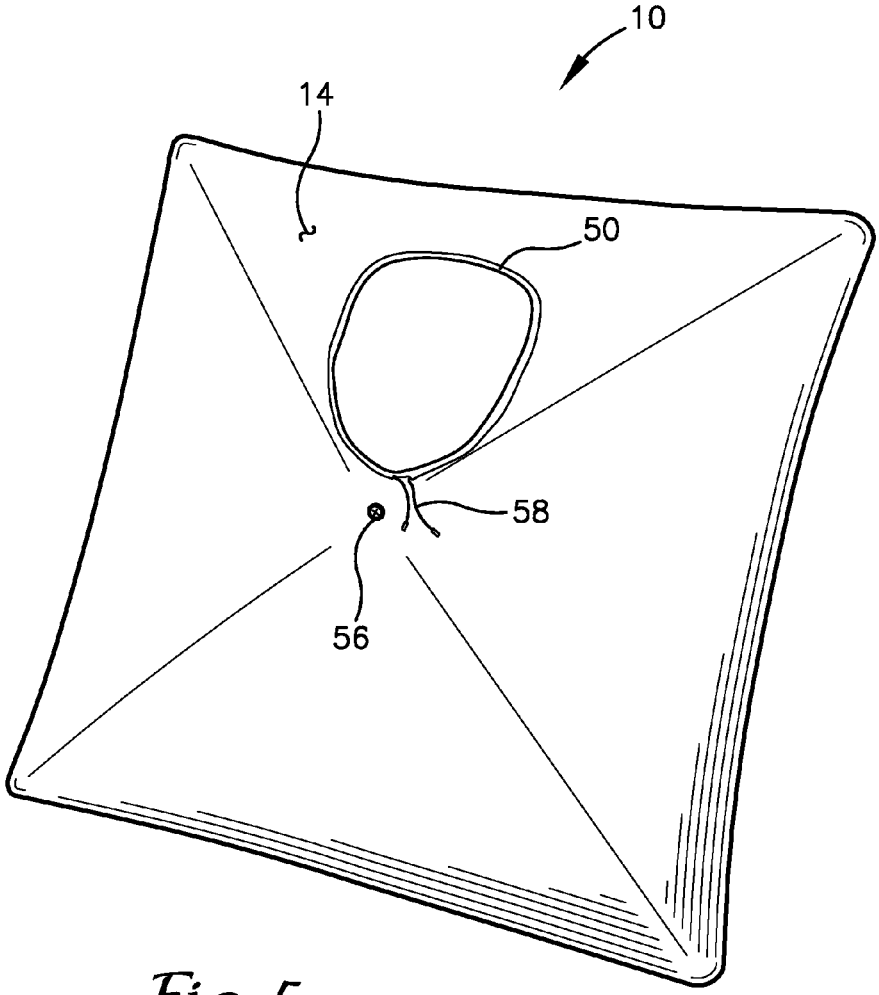
FIG. 5 is a front perspective view of the hunting blind of FIG. 3B depicted in an open orientation.

The receivers 22 also include a pair of pins 24 extending from opposite sides thereof, as depicted in FIG. 3A. The receivers 22 are each disposed within a respective cutout or receptacle 26 in the hub 16 with the pins 24 engaging sidewalls of the receptacle 26 to enable pivotal movement of the receivers 22 and, thus the legs 18, with respect to the hub 16. The receptacles 26 and/or the receivers 22 include a feature (not shown) such as a wall, tab, or other obstruction that limits pivotal movement of the receivers 22. As such, the receivers 22 are only pivotable between an orientation extending from a front side 28 of the hub 16 and generally parallel to one another, e.g. a closed orientation as depicted in FIG. 4, and a plane extending radially outward from the hub 16, e.g. a deployed orientation as depicted in FIGS. 1 and 5.

Figure 3B:
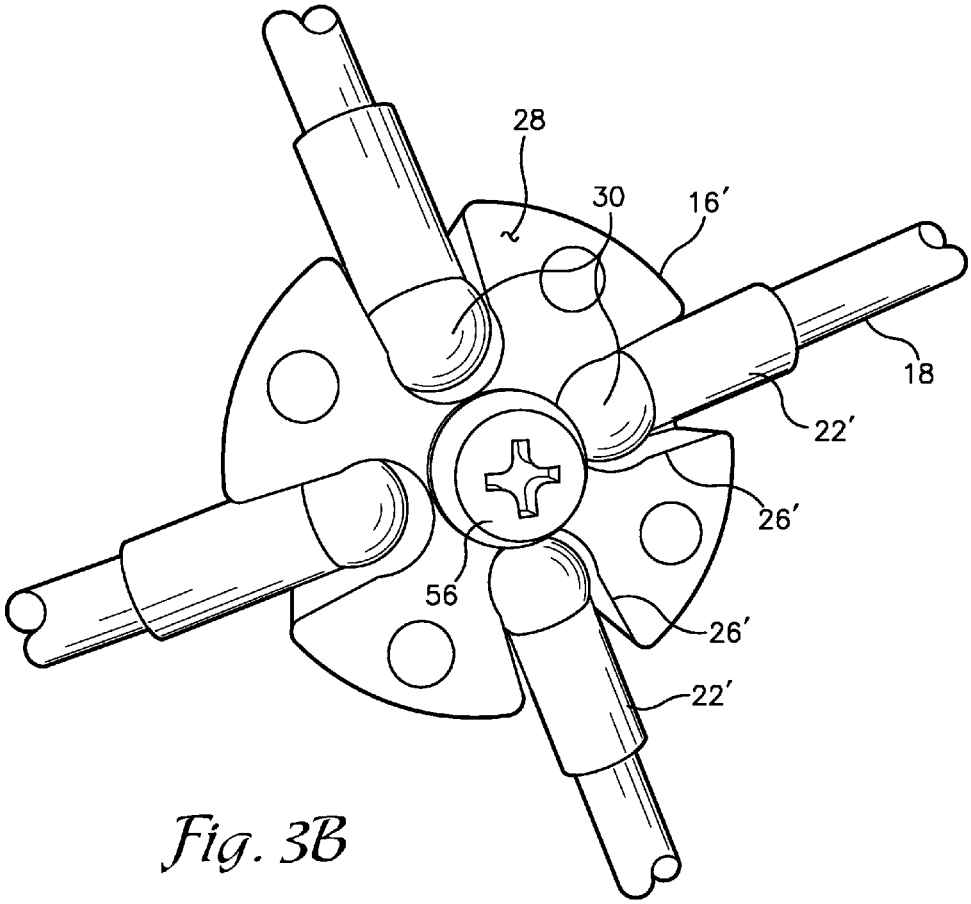
FIG. 3B is a rear perspective view of a central hub of a hunting blind depicted in accordance with another embodiment of the invention.

Alternatively, as depicted in FIG. 3B, receivers 22' include an enlarged spherical head 30. Receptacles or sockets 26' in the hub 16' are thus configured to trap the spherical heads 30 therein to restrict axial movements toward or away from the hub 16' and to enable pivotal movements of the receivers 22' within the sockets 26' between the closed and deployed orientations.

Also as depicted in FIG. 3A, the proximate ends of the legs 18 can include an adjustment screw 32, threaded fastener, or similar component that is adjustable axially along the length of the leg 18. The extension of the adjustment screw 32 is adjustable to increase or decrease the depth of insertion of the leg 18 into the receiver 22 and thus the length of the leg 18 extending from the hub 16. These adjustments are useable to tailor the fit and tension on the cover 14. For example, lengthening the leg 18 allows a user to tighten the cover 14 over the frame 12 to at least slightly stretch the fabric cover 14. The legs 18 might also be lengthened to account for loosening of the fabric resulting from use and/or aging of the fabric. An adjustment screw 32 can be provided in the distal ends of the legs 18 and similarly operated to adjust the fit of the cover 14.

With continued reference to FIG. 2, the hub 16 includes a mounting member 34 extending from a rear side 36 thereof. The mounting member 34 includes a faceted rod 38 extending therefrom with a detent, depression, or groove 40 about its circumference and near a distal end thereof. The faceted rod 38 is configured for reception by a coupling member 42 associated with a bow, stand, or other support device. The faceted rod 38 is shown with a hexagonal cross-sectional shape in the drawings however, it is understood that the faceted rod 38 can be configured with any number of sides.

The coupling member 42 is preferably a quick-connect-style coupler like, for example, the automatic tool-bit holder described by Wienhold in U.S. Pat. No. 6,561,523, the disclosure of which is hereby incorporated herein by reference. Such a coupling functions by biasing bearings (not shown) into the groove 40. Sliding a collar 44 along a shaft 46 of the coupling member 42 releases spring pressure on bearings and allows the bearings to move out of the groove 40, thereby releasing the rod 38. FIG. 2 shows the coupling 42 and shaft 34 separated for clarity. One of skill in the art will recognize that the coupling member 42 can be configured in other ways to perform substantially the same function. Such other ways are within the scope of embodiments of the invention described herein.

The hub 16 can be coupled to the coupling member 42 and therefore a bow, stand, or other supporting object or device attached to the coupling member 42 by simply pushing the faceted rod 34 into an opening 48 of the coupling member 42 and engaging the bearings in the groove 40. Once connected, interaction between the facets of the faceted rod 34 and the similarly faceted opening 48 restricts rotation of the hub 16 relative to the coupling member 42 and therefore the bow, stand, or other support device. In a preferred embodiment, it is important that the blind 10 not move or rotate relative to the coupling member 42 as this would create obvious problems for the hunter in trying to shoot through an opening 50 in the cover 14, but in other embodiments, such rotation may be desirable and the coupling between the hub 16 and the coupling member 42 can be configured to provide such rotation.

Referring again to FIGS. 1 and 2, the cover 14 comprises a flexible, resilient material dimensioned to extend between the legs 18. The material can be printed, dyed, or otherwise provided with any desired pattern, logo, or other design. Preferably, the cover 14 is printed with a camouflage pattern that mimics an environment in which the blind 10 is to be used. In one embodiment, the cover 14 is dimensioned to provide a square shape with an area of approximately one square yard (approximately nine square feet). Such dimensions enable use of materials or fabrics that are commonly constructed in approximately one-yard (three-foot) widths and with printed patterns that repeat approximately every yard (three feet) along the length of the fabric or material. As such, manufacturing costs and issues associated with dimensions of the blind 10 and fabric can be minimized. And the effectiveness of a camouflage pattern that is displayed by the blind 10 is maximized because no repetition of the pattern is displayed, e.g. a repetition of the camouflage pattern might be discernable by an onlooker from a surrounding environment. The cover 14 can also be comprised of multiple layers of similar or dissimilar materials. A plurality of different covers 14 can also be interchangeably employed.

As depicted in FIGS. 1 and 2, the cover 14 is provided with a pocket 20 disposed at each corner thereof which include reinforced portions that receive the distal ends of the legs 18 to couple the cover 14 to the legs 18. The cover 14 is further retained against the central hub 16 via an elastic band 52, strap, or similar lashing that extends through a pair of holes 54 in the cover 14 near the hub 16 and around the mounting member 34. This arrangement holds the cover 14 against the hub 16 as the blind 10 is opened and closed. Alternatively, as depicted in FIG. 5, the cover 14 is coupled to the hub 16 via a fastener 56 inserted through the cover 14 and into the hub 16.

An opening 50 is provided between adjacent legs 18 on an upper portion of the cover 14. The opening 50 is sized to enable a user to view a target through the opening 50 as well as fire a bow, gun, camera, or the like through the opening 50. As depicted in FIG. 5, a drawstring 58 can be provided around the opening 50 to at least partially close off the opening 50. Cinching of the opening 50 via the drawstring 58 is also useable to adjust tension in the cover 14 in addition to or in place of the adjustment screws 32 described previously.

Figure 6:
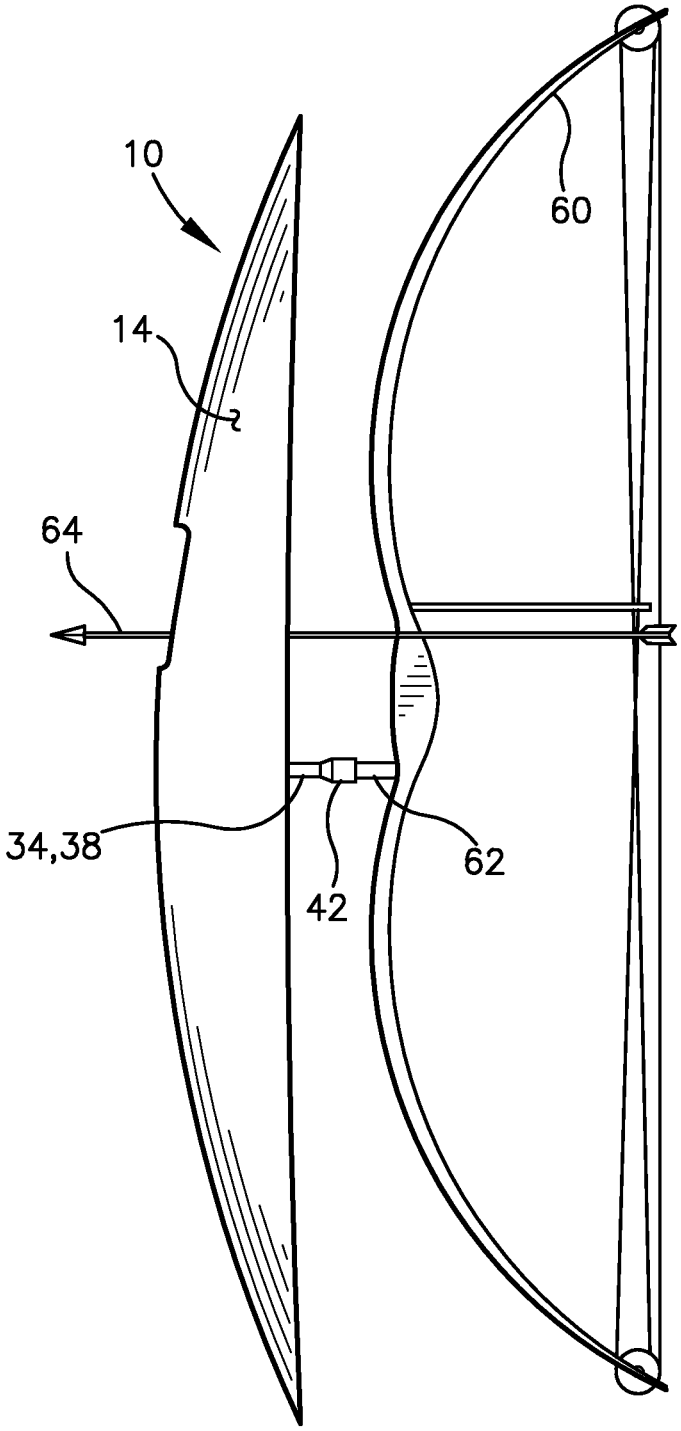
FIG. 6 is a side elevational view of a hunting blind coupled to a bow in accordance with an embodiment of the invention.

The blind 10 is configurable for use with a bow or with a gun as well as for photography, among other uses. As depicted in FIG. 6, a bow 60 can be fitted with or include a stabilizer 62 extending from a forward portion thereof as known in the art. The bow 60 can be any type or configuration, such as a long bow, compound bow, or the like. The stabilizer 62 includes a distal end on which the coupler 42 is disposed. The blind 10 can thus be coupled thereto by inserting the faceted rod 38 into the coupler 42 to engage the coupler 42. Such a configuration provides the opening 50 in the cover 14 in general alignment with an arrow 64 to be shot from the bow 60 and provides the user with adequate space for viewing the target through the opening 50. It is also foreseeable that the blind 10 might be mounted on a gun or firearm such as a cross-bow in a manner similar to that of the bow 60.

Figure 7:
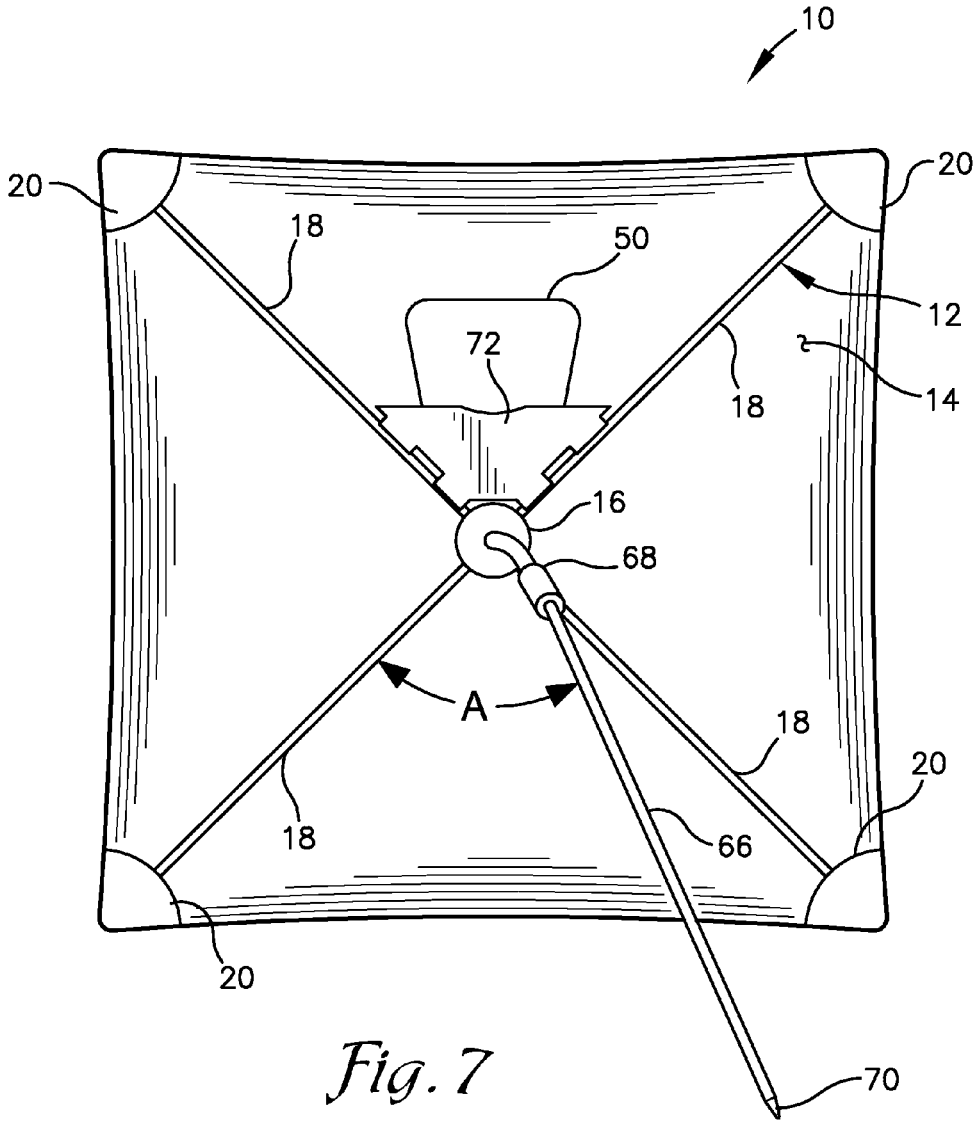
FIG. 7 is a rear elevational view of a hunting blind depicted with a brace and a support leg disposed thereon in accordance with an embodiment of the invention.

The blind 10 can be placed on the ground such as when hunting with a gun or photographing a subject. As shown in FIG. 7, a support leg 66 is provided for use on the ground. The support leg 66 is similar in size and form to the legs 18 of the frame 12 but includes a flexible and/or pivotable coupler 68 at a first end.

The coupler 68 may comprise a section of tubing made from a rubber, plastic, or similarly flexible and resilient material that is friction fit onto the faceted rod 38. Alternatively, the coupler 68 might include quick-connect-style coupler like the coupling member 42 described above with a mechanical pivotable and/or rotatable joint like a u-joint or ball joint affixed thereto. The coupler 68 is configured to attach to the faceted rod 38 and to enable the support leg 66 to extend away from the rear side 36 of the hub 16 at an angle toward the ground. An opposite second end of the support leg 66 is placed in contact with the ground to, along with the lower legs 18 of the frame 12, support the blind 10 on the ground in a tripod-style orientation.

The coupler 68 enables the support leg 66 to be moved to any angular position relative to the frame 12 as shown by arrow A in FIG. 7. This arrangement allows a hunter positioned behind the blind to move the support leg 66 to a desired position that both supports the blind 10 and does not obstruct the hunter's movements or view. The second end of the support leg 66 may include a removable tip, pad, or end piece 70 that can be changed out for different surfaces, e.g. a pointed tip for inserting into a soft surface or a wide rubberized pad for a hard rocky surface.

Figure 8:
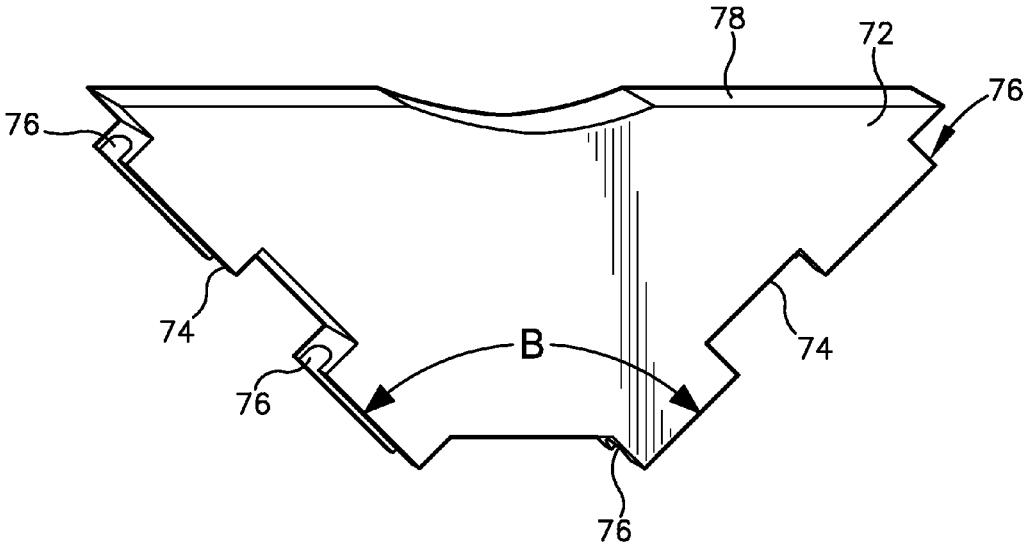
FIG. 8 is a perspective view of the brace of FIG. 7.

The blind 10 can include a brace 72 positioned below opening 50 as depicted in FIGS. 7 and 8. The brace 72 has sidewalls 74 angled at an angle B so as to fit into the space created above the hub 16 and between the two adjacent upper legs 18 of the frame 12, as shown in FIG. 7. Each sidewall 74 includes an upper and lower slot 76 sized to fit snuggly over the diameter of the respective leg 18. A top wall 78 of the brace 72 forms a solid surface on which a gun or camera lens can be rested.

Figure 9:
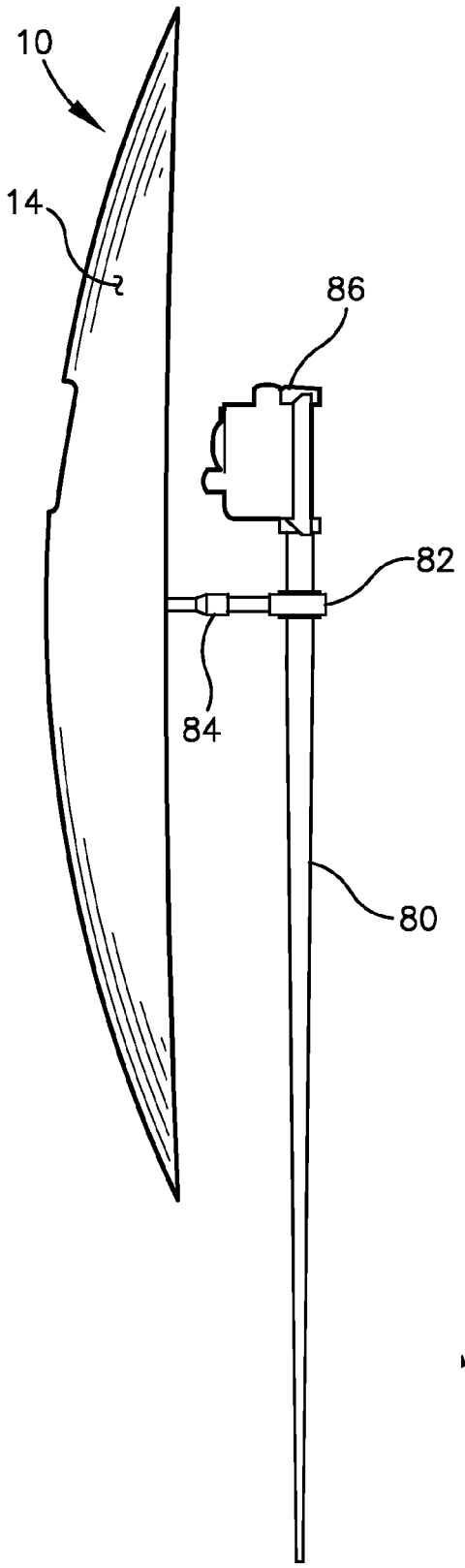
FIG. 9 is a side view of a hunting blind mounted on a support pole in accordance with an embodiment of the invention.

With reference to FIG. 9, the blind 10 is depicted mounted on a camera support pole 80. The camera support pole 80 is any camera mount, pole, tripod, or similar camera support device known in the art. The pole 80 includes a clamp 82 affixed along the length of the pole 80. A coupling member 84, like the coupling member 42, extends from the clamp 82 to receive and couple to the faceted rod 38 of the blind 10. As such, a user can place the blind 10 at a desired height for viewing through the opening 50 and/or capturing images through the opening 50 using a camera 86 mounted on the pole 80. The clamp 82 might also be affixed to another object or structure like a tree, hunting stand, or the like to support the blind 10.

Figure 10:
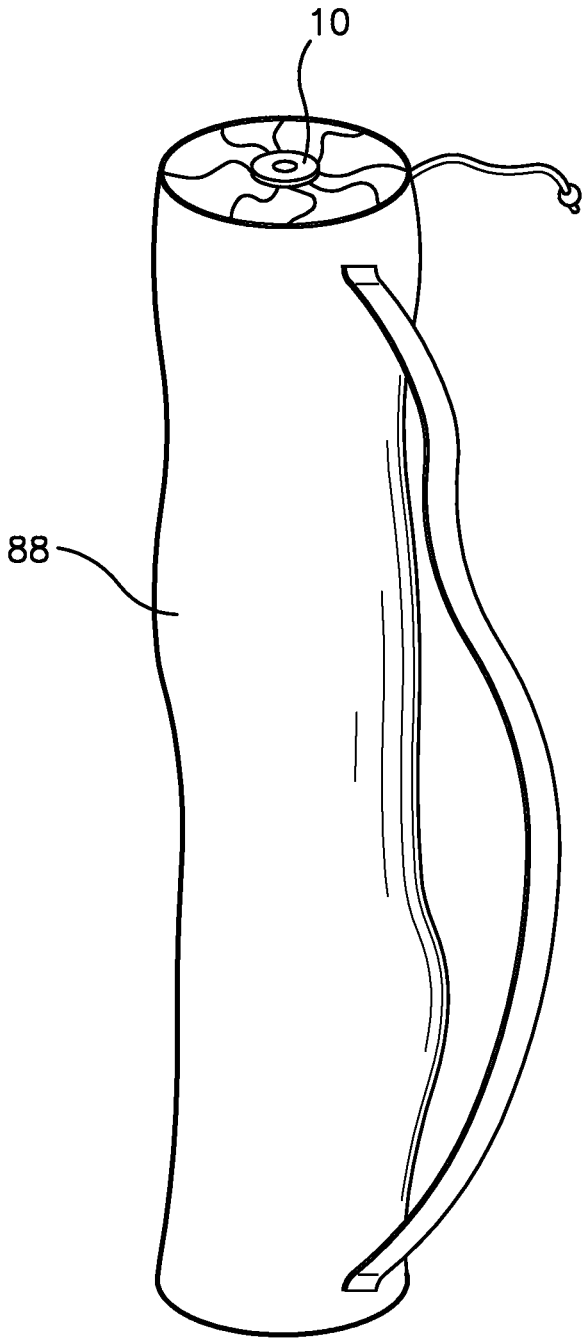
FIG. 10 is a perspective view of a carrying and storage container with a hunting blind disposed therein depicted in accordance with an embodiment of the invention.

In operation, the blind 10 may initially be placed in the closed orientation depicted in FIG. 4, in which it is folded down for storage or transport. A carrying case 88, such as a tubular bag, may be provided in which the device 10 can be disposed while in a closed orientation, as depicted in FIG. 10.

To deploy the blind 10, the legs 18 are first pivoted away from one another to extend radially outward from the hub 16. As the legs 18 near an orientation in which each of the legs 18 and the hub 16 lie in substantially the same plane, the cover 14 is placed in tension. The legs 18 flex and/or the cover 14 stretches to allow the distal ends of the legs 18 to pass through the plane toward the rear side 36 of the hub 16 while the proximate ends of the legs 18 are prevented from pivoting past the plane. The tension in the cover 14 provides an over-center condition that retains the distal ends of the legs 18 in position beyond the plane (e.g. to the rear side of the plane) and causes the legs 18 to bow at least partially toward the rear side 36 of the hub 16. As such, the legs 18 are retained in the deployed orientation by the tension in the cover 14.

To return the blind 10 to the closed orientation, one or more of the legs 18 is pivoted or flexed toward the front side 28 of the hub 16, through the plane, and past the over-center condition provided by the cover 14. The tension in the cover 14 is thereby released and the remaining legs 18 can freely pivot to the closed orientation. The blind 10 can be coupled to the bow 60, the support leg 66, or the camera support pole 80 as described above, or to another support member in either the closed or deployed orientation.

Figure 11A:
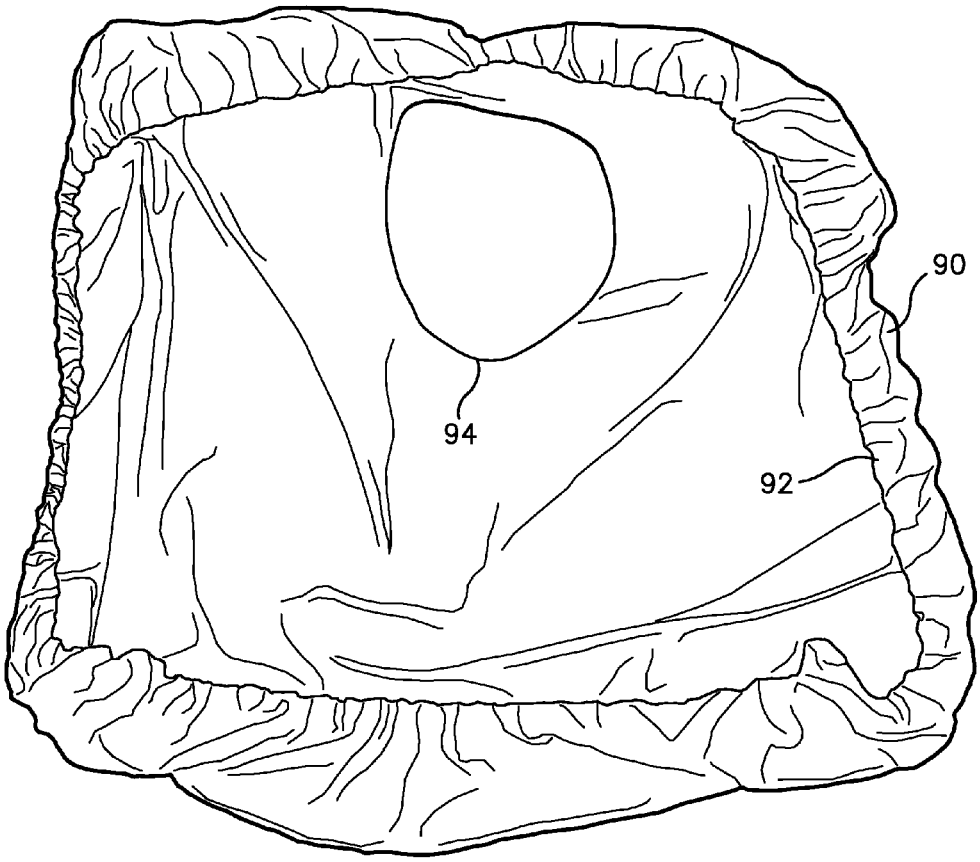
FIG. 11A is a rear view depicting a supplemental cover that is useable to change a displayed camouflage pattern of the hunting blind in accordance with an embodiment of the invention.
Figure 11B:
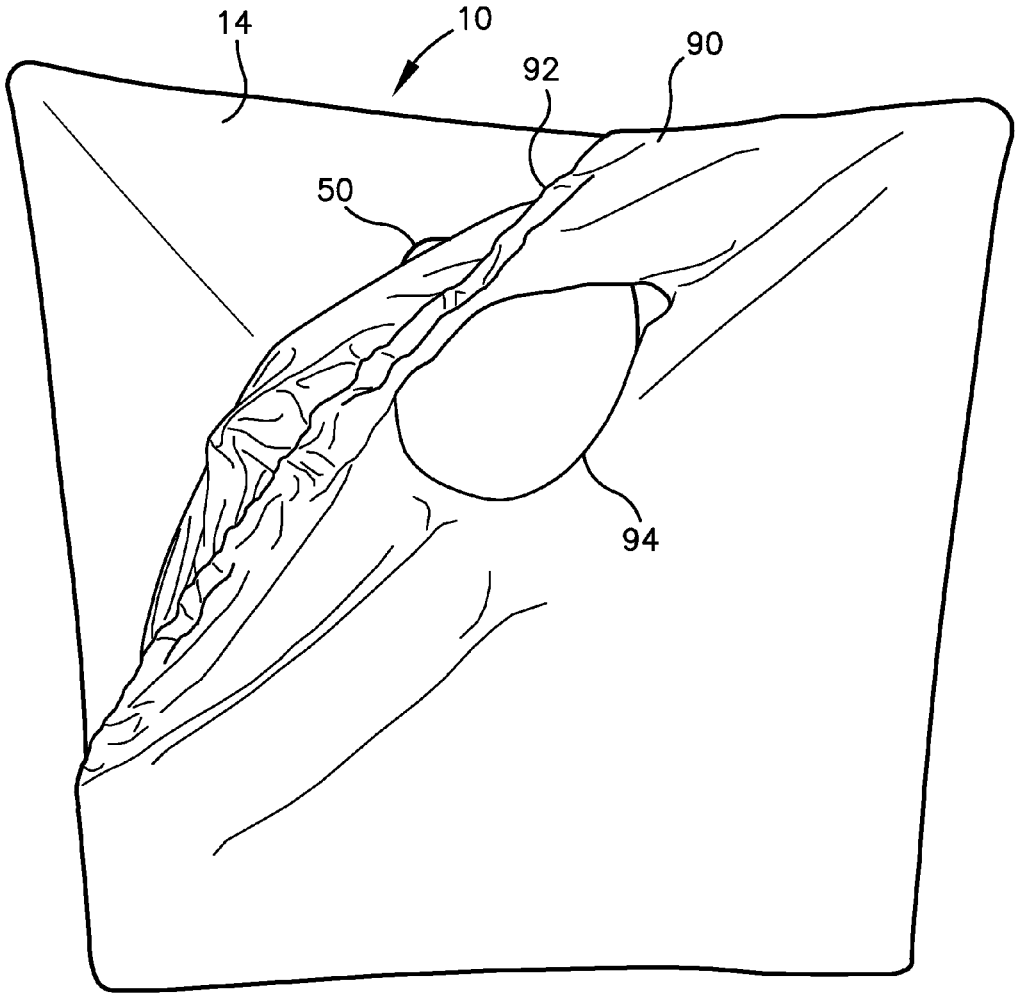
FIG. 11B is a front view of a hunting blind depicting the supplemental cover of FIG. 11A partially disposed thereon in accordance with an embodiment of the invention.
Figure 11C:
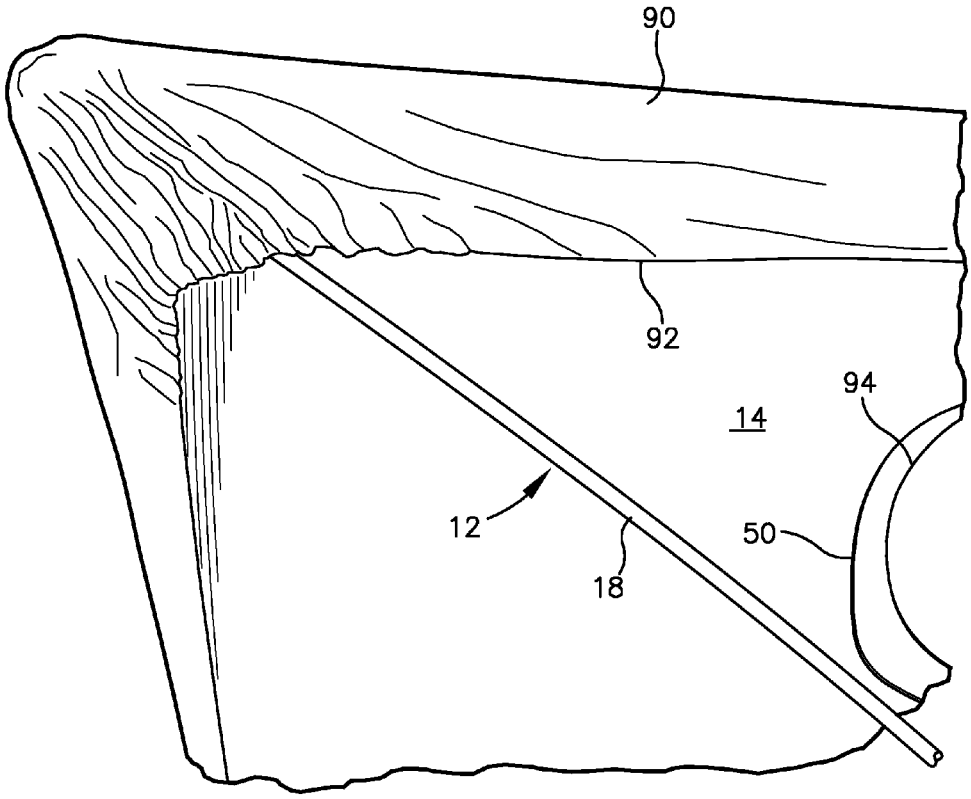
FIG. 11C is a partial rear elevational view of the hunting blind of FIG. 11B depicting the add-on cover wrapping around a perimeter thereof in accordance with an embodiment of the invention.

With reference to FIGS. 11A-C, one or more supplemental covers 90 can be disposed on the blind 10. The supplemental cover 90 comprises a section of material dimensioned to cover a front side of the cover 14 and to wrap around at least a portion of the perimeter of the blind 10 to retain the supplemental cover 90 thereon. As depicted in FIG. 11A, the supplemental cover 90 includes an elastic band extending around at least a portion of a perimeter 92 thereof. The perimeter of the supplemental cover 90 can thus be wrapped around the perimeter of the blind 10 to retain the supplemental cover 90 on the blind 10 in a manner similar to a fitted bed sheet on a mattress; FIG. 11B depicts the supplemental cover 90 partially installed on the blind 10 and FIG. 11C depicts a rear side of the blind 10 with the supplemental cover 90 installed and wrapped around the perimeter of the blind 10. The supplemental cover 90 might alternatively include drawstrings, straps, hook-and-loop fasteners, snaps, or the like in addition to or instead of the elastic band for attaching to the blind 10. An opening 94 is provided in the supplemental cover 90 to generally match and align with the opening 50 in the cover 14 so as not to obstruct the opening 50.

The supplemental cover 90 can be printed with a desired pattern or design that is the same as or different from the cover 14. Accordingly, the supplemental cover 90 can be employed to alter the appearance of the blind 10 based on environmental conditions, e.g. a supplemental cover 90 printed with a camouflage appropriate for a grassy field or a desert terrain can be applied when hunting in such conditions to hide or change the appearance of the blind 10 having a cover 14 designed for wooded terrain. The supplemental cover 90 can also add to or enhance a camouflage pattern printed on the cover 14. For example, the supplemental cover 90 might include a plurality of slits, cutouts, or loosely attached portions or flaps similar to a Ghillie camouflage or other three-dimensional camouflage known in the art.

In another embodiment, the supplemental cover 90 can be configured to provide weather resistance qualities like waterproofing or wind proofing such that the blind 10 can be employed to protect the user from such weather conditions. For example, a waterproof supplemental cover 90 that does not include the opening 94 might be employed to enable the blind 10 to function as an umbrella.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A collapsible hunting blind comprising:

a central hub having a mounting member extending from a first side thereof, the mounting member including a faceted rod;

a plurality of legs pivotally coupled to the central hub and configured to pivot between a closed position and a deployed position, the legs in the closed position extending from a second side of the central hub and in the deployed position extending radially outwardly from the central hub;

a cover coupled to a distal end of each of the plurality of legs and extending between the legs in the deployed position, the cover being placed in tension in the deployed position to retain the legs in the deployed position, the cover including an opening positioned between a pair of adjacent legs of the plurality of legs; and a coupling member coupled between the faceted rod and a supporting object, the coupling member engaging the faceted rod to restrict rotation of the coupling member relative to the faceted rod.

2. The collapsible hunting blind of claim 1, further comprising:

a receiver disposed on a proximate end of each of the legs, the receiver including a blind bore into which the proximate end of the leg is disposed and including a generally spheroidal head; and a plurality of sockets disposed about the circumference of the central hub, each of the sockets being configured to receive a respective one of the receivers, the sockets enabling pivotal movement of the receivers between the closed and deployed orientations and engaging the spheroidal heads of the receivers to restrict withdrawal of the receivers from the sockets.

3. The collapsible hunting blind of claim 2, wherein each of the legs is retained in the respective one of the receivers by friction fit.

4. The collapsible hunting blind of claim 2, wherein one or more of the legs includes an adjustment member at one or more of the proximate and distal ends thereof that is extendable from the respective end to increase the length of the leg.

5. The collapsible hunting blind of claim 1, further comprising:

a drawstring disposed about a perimeter of the opening in the cover, the drawstring being useable to adjust the tension in the cover in the deployed position.

6. The collapsible hunting blind of claim 1, wherein the supporting object is one of a bow, a camera support, and a support leg.

7. The collapsible hunting blind of claim 1, wherein the faceted rod includes a depression disposed adjacent a distal end of the faceted rod, and the coupling member comprises a quick-connect-style coupling that engages the depression.

8. The collapsible hunting blind of claim 7, wherein the coupling member includes a collar disposed on a shaft, wherein the collar is biased in a first axial direction along the shaft, and wherein the collar is moved in a second axial direction that is opposite to the first direction to enable withdrawal of the faceted rod from the coupling member.

9. The collapsible hunting blind of claim 1, further comprising:

a supplemental cover that is configured to overlie the cover in the deployed position and to wrap around at least a portion of a perimeter of the cover.

10. The collapsible hunting blind of claim 9, wherein the supplemental cover includes an elastic band disposed along an edge of the supplemental cover, the elastic band providing tension in a portion of the supplemental cover that wraps around the perimeter of the cover to retain the supplemental cover in engagement with the cover in the deployed position.

11. The collapsible hunting blind of claim 9, wherein the cover is printed with a first visual pattern and the supplemental cover is printed with a different second visual pattern.

12. A collapsible hunting blind comprising:

a central hub having a mounting member extending from a first side thereof;

a plurality of legs pivotally coupled to the central hub and configured to pivot between a closed position and a deployed position, the legs in the closed position extending from a second side of the central hub and in the deployed position extending radially outwardly from the central hub;

a cover coupled to a distal end of each of the plurality of legs and extending between the legs in the deployed position, the cover being placed in tension in the deployed position to retain the legs in the deployed position, the cover including an opening positioned between a pair of adjacent legs of the plurality of legs; and a support leg pivotably coupled to the mounting member by a flexible element that enables pivoting of the support leg in any direction relative to the central hub and supporting the blind in the deployed position on a ground surface.

13. The collapsible hunting blind of claim 12, wherein the flexible element comprises a section of tubing.

14. The collapsible hunting blind of claim 12, wherein the support leg includes an interchangeable end piece disposed at a distal end thereof.

15. The collapsible hunting blind of claim 12, further comprising:

a brace having a pair of angled sidewalls and a top wall extending therebetween, the angled sidewalls being configured to receive the pair of adjacent legs of the plurality of legs to support the top wall in a position intersecting the opening in the cover, the top wall being configured to support one or more of a firearm and a camera disposed in the opening in the cover.

16. A bow-mounted hunting blind comprising:

a bow having a stabilizing rod extending therefrom;

a coupling member affixed to the stabilizing rod;

a central hub having a mounting member extending from a first side thereof toward the bow, the mounting member including a faceted rod, the faceted rod being engaged by the coupling member to couple the central hub to the bow and to restrict rotation of the coupling member relative to the faceted rod;

a plurality of legs pivotally coupled to the central hub and configured to pivot between a closed position and a deployed position, the legs in the closed position extending from a second side of the central hub and in the deployed position extending radially outwardly from the central hub; and a cover coupled to a distal end of each of the plurality of legs and extending between the legs in the deployed position, the cover being placed in tension in the deployed position to retain the legs in the deployed position, the cover including an opening positioned between a pair of adjacent legs of the plurality of legs, the opening being sized and positioned to enable passage of an arrow from the bow through the opening.

17. The bow-mounted hunting blind of claim 16, wherein the opening is sized to enable viewing of a target of the arrow through the opening.

18. The bow-mounted hunting blind of claim 16, further comprising:

a supplemental cover that is configured to overlie the cover in the deployed position and to wrap around at least a portion of a perimeter of the cover.

19. The bow-mounted hunting blind of claim 16, further comprising:

a drawstring disposed about a perimeter of the opening in the cover, the drawstring being useable to adjust the tension in the cover in the deployed position.

* * * * *